US010522075B2

(12) United States Patent
Pyo et al.

(10) Patent No.: US 10,522,075 B2
(45) Date of Patent: Dec. 31, 2019

(54) ORGANIC LIGHT EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Si Beak Pyo, Yongin (KR); Won Ju Shin, Yongin (KR); Ye Ji Lee, Yongin (KR); Jong Dae Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/159,671

(22) Filed: May 19, 2016

(65) Prior Publication Data

US 2017/0011682 A1 Jan. 12, 2017

(30) Foreign Application Priority Data

Jul. 6, 2015 (KR) ..... 10-2015-0095956

(51) Int. Cl.
*G09G 3/3225* (2016.01)
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0262* (2013.01); *G09G 2320/043* (2013.01); *G09G 2320/0626* (2013.01)

(58) Field of Classification Search
CPC ..... G09G 3/3225; G09G 3/3208; G09G 2300/0814; G09G 2300/0861; G09G 2310/04; G09G 2320/0626; G09G 3/3233; G09G 2300/0819; G09G 2310/0262; G09G 2320/043
See application file for complete search history.

(56) References Cited

U.S. PATENT DOCUMENTS

| | | | |
|---|---|---|---|
| 2012/0098870 | A1 | 4/2012 | Barnhoefer et al. |
| 2013/0169693 | A1 | 7/2013 | Pyo |
| 2013/0176349 | A1 | 7/2013 | Park et al. |
| 2013/0194316 | A1 | 8/2013 | Park et al. |
| 2013/0321485 | A1 | 12/2013 | Eom et al. |

(Continued)

FOREIGN PATENT DOCUMENTS

| | | | |
|---|---|---|---|
| KR | 10-2006-0122307 | A | 11/2006 |
| KR | 10-2013-0136338 | A | 12/2013 |
| KR | 10-2015-0010807 | A | 1/2015 |

*Primary Examiner* — Wing H Chow
(74) *Attorney, Agent, or Firm* — Innovation Counsel LLP

(57) ABSTRACT

There is provided an organic light emitting display device including a display panel including pixels and a display panel driver configured to drive the display panel. The display panel driver is arranged to receive a maximum brightness signal. When a maximum brightness determined corresponding to the maximum brightness signal is lower than a first reference maximum brightness for a frame, the display panel driver is programmed to direct less than all of the pixels to emit light components during a frame period of the frame. When the maximum brightness is higher than the first reference maximum brightness and is lower than a second reference maximum brightness, the display panel driver is programmed to direct all of the pixels to emit light components during only part of the frame period. The second reference maximum brightness is higher than the first reference maximum brightness.

19 Claims, 6 Drawing Sheets

(a) GRAYSCALES CORRESPONDING TO INPUT IMAGE SIGNALS (Imax: 150 nit)

(b) SCREEN ON WHICH PIXELS ARE DISPLAYED IN FIRST FRAME Frame 1 (Imax' : 300 nit)

(c) SCREEN ON WHICH PIXELS ARE DISPLAYED IN SECOND FRAME Frame 2 (Imax' : 300 nit)

(56) References Cited

U.S. PATENT DOCUMENTS

| | | | | |
|---|---|---|---|---|
| 2014/0058483 | A1* | 2/2014 | Zao | A61N 5/06 607/88 |
| 2014/0125714 | A1 | 5/2014 | Pyo | |
| 2015/0097764 | A1 | 4/2015 | Pyo et al. | |
| 2015/0138251 | A1 | 5/2015 | Pyo | |

* cited by examiner

ORGANIC LIGHT EMITTING DISPLAY DEVICE AND METHOD OF DRIVING THE SAME

CROSS-REFERENCE TO RELATED APPLICATION

This application claims priority to, and the benefit of, Korean Patent Application No. 10-2015-0095956, filed on Jul. 6, 2015 in the Korean Intellectual Property Office, the entire contents of which are incorporated herein by reference in their entirety.

BACKGROUND

1. Field

Embodiments of the present invention relate generally to organic light emitting display devices. More specifically, embodiments of the present invention relate to organic light emitting display devices having dimming capability, and methods of driving the same.

2. Description of the Related Art

Recently, various display devices have been developed that are smaller and lighter than conventional cathode ray tube displays. These display devices include a liquid crystal display device, a field emission display device, a plasma display panel device, and an organic light emitting display device.

Dimming that controls maximum brightness of the organic light emitting display device, and increasing the number of possible maximum brightness steps, have been the focus of resent research efforts. However, when the number of possible maximum brightness steps increases, in the case in which the possible maximum brightness steps and grayscales are received, a size of a look-up table for outputting a data voltage increases.

SUMMARY

An embodiment of the present invention relates to an organic light emitting display device capable of minimizing a degree of increase in size of a look-up table required for increasing the number of possible maximum brightness steps, and a method of driving the same.

Another embodiment of the present invention relates to an organic light emitting display device in which a display panel driver includes a brightness look-up table for increasing the number of possible maximum brightness steps with no or reduced increase in look-up table size.

An organic light emitting display device according to an embodiment of the present invention includes a display panel including pixels, and a display panel driver configured to drive the display panel. The display panel driver is arranged to receive a maximum brightness signal. When a maximum brightness corresponding to the maximum brightness signal is lower than a first reference maximum brightness for a frame, the display panel driver is programmed to direct less than all of the pixels to emit light components during a frame period of the frame. When the maximum brightness is higher than the first reference maximum brightness and is lower than a second reference maximum brightness, the display panel driver is programmed to direct all of the pixels to emit light components during only part of the frame period. The second reference maximum brightness is higher than the first reference maximum brightness.

The display panel driver may further include a maximum brightness look-up table configured to output data voltage levels based on input maximum brightness and grayscales. When the maximum brightness is higher than the second reference maximum brightness, the display panel driver may be programmed to input the maximum brightness to the maximum brightness look-up table. When the maximum brightness is lower than the second reference maximum brightness, the display panel driver may be programmed to convert the maximum brightness into a value higher than the second reference maximum brightness so as to form a converted maximum brightness, and to input the converted maximum brightness to the maximum brightness look-up table.

The maximum brightness look-up table may be included in the timing controller or the data driver.

The display panel driver may include a timing controller configured to receive image signals, timing signals, and the maximum brightness signal and to supply a scan timing control signal and a data timing control signal. The timing controller can include a whether-to-convert signal generator configured to generate a whether-to-convert signal and an image signal converter configured to receive the whether-to-convert signal. When the maximum brightness is lower than the first reference maximum brightness, the whether-to-convert signal generator may be further configured to generate a whether-to-convert signal having a first logic value, the image signal converter may be further configured to convert the image signals, and the timing controller may be further configured to output the converted image signals. When the maximum brightness is higher than the first reference maximum brightness, the whether-to-convert signal generator may be further configured to generate a whether-to-convert signal having a second logic value different from the first logic value, and the timing controller may be further configured to output the image signals.

The image signal converter may be further configured to store pixel information corresponding to an image signal. When the maximum brightness is lower than the first reference maximum brightness, the image signal converter may be further configured to generate the converted image signals so that some of the converted image signals correspond to a black grayscale.

When the maximum brightness is lower than the first reference maximum brightness, the timing controller may be further configured to convert the maximum brightness to a value higher than the second reference maximum brightness so as to form a converted maximum brightness. When the image signals are displayed based on the maximum brightness, an average brightness of the corresponding pixels may be substantially equal to an average brightness of the corresponding pixels when the converted image signals are displayed based on the converted maximum brightness.

The display panel may include data lines configured to transmit data voltages to the pixels, scan lines configured to transmit scan signals to the pixels, and emission control lines configured to transmit emission control signals to the pixels. The timing controller may be configured to supply an emission control timing control signal. The display panel driver may further include a data driver configured to further supply an emission control timing control signal, to generate the data voltages based on the image signals or the converted image signals, and to supply the data voltages to the data lines based on a timing at which the scan timing control signal is supplied, a scan driver configured to supply the scan signals to the scan lines based on a timing at which the scan timing control signal is supplied, and an emission control driver configured to supply the emission control signals based on a timing at which the emission control timing control signal is supplied.

When the maximum brightness is higher than the first reference maximum brightness and is lower than the second reference maximum brightness, the emission control timing control signal can include information describing a non-emission period. When the maximum brightness is higher than the second reference maximum brightness, the emission control timing control signal may not include the information describing the non-emission period.

When the maximum brightness is higher than the first reference maximum brightness and is lower than the second reference maximum brightness, the timing controller may be configured to convert the maximum brightness to a value higher than the second reference maximum brightness. When the image signals are displayed based on the maximum brightness and an emission control timing control signal that does not include the information describing the non-emission period, an average brightness of the corresponding pixels may be substantially equal to an average brightness of the corresponding pixels when the image signals are displayed based on the converted maximum brightness and an emission control timing control signal including the information describing the non-emission period.

When the maximum brightness is lower than the first reference maximum brightness, the pixels may not emit light components during a portion of the frame period.

A method of driving an organic light emitting display device including a display panel having pixels and a display panel driver configured to drive the display panel according to another embodiment of the present invention includes receiving image signals and timing signals, receiving a maximum brightness signal corresponding to a maximum brightness, converting image signals, generating an emission control timing control signal including information on a non-emission period, calling a look-up table, and directing the pixels to emit light components. The converting is conditionally performed when the maximum brightness is lower than a first reference maximum brightness. The generating is conditionally performed when the maximum brightness is higher than the first reference maximum brightness and is lower than a second reference maximum brightness. The second reference maximum brightness is higher than the first reference maximum brightness.

The generating may be performed after the converting.

The converting may further comprise generating an emission control timing control signal that does not include the information on the non-emission period is generated.

The method further includes converting the maximum brightness. The converting the maximum brightness may be performed after the converting the image signals or the generating an emission control timing control signal, and may be performed before the calling a look-up table.

The converting the image signals may include generating pixel information, and converting image signals corresponding to some of the pixel information to correspond to a black grayscale.

The converting the maximum brightness may further comprise generating a converted maximum brightness. A level of the converted maximum brightness may be set so that an average brightness of pixels when the image signals are displayed based on the maximum brightness is substantially equal to an average brightness of pixels when converted image signals are displayed based on the converted maximum brightness.

The generating an emission control timing control signal may further comprise determining a length of the non-emission period and generating the emission control timing control signal based on the determined length of the non-emission period.

The converting the maximum brightness may further comprise generating a converted maximum brightness. A level of the converted maximum brightness may be set so that an average brightness of pixels when the image signals are displayed based on the maximum brightness and the emission control timing control signal that does not include the information on the non-emission period may be substantially equal to an average brightness of pixels when image signals are displayed based on the converted maximum brightness and the emission control timing control signal including the information on the non-emission period.

The method further includes, when the maximum brightness is higher than the second reference maximum brightness, generating an emission control timing control signal that does not include information on a non-emission period.

In the organic light emitting display device according to the embodiment of the present invention and the method of driving the same, the degree of the increase in size of the look-up table required for increasing the number of possible maximum brightness steps is minimized.

In addition, in the organic light emitting display device according to the embodiment of the present invention and the method of driving the same, since the degree of the increase in size of the look-up table required for increasing the possible maximum brightness steps is minimized, although the possible maximum brightness steps increase, the display panel driver may include the look-up table.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the drawing figures, dimensions may be exaggerated for clarity of illustration. The various figures are thus not necessarily to scale. It will be understood that when an element is referred to as being "between" two elements, it can be the only element between the two elements, or one or more intervening elements may also be present. Like reference numerals refer to like elements throughout.

DETAILED DESCRIPTION

Figure 1:
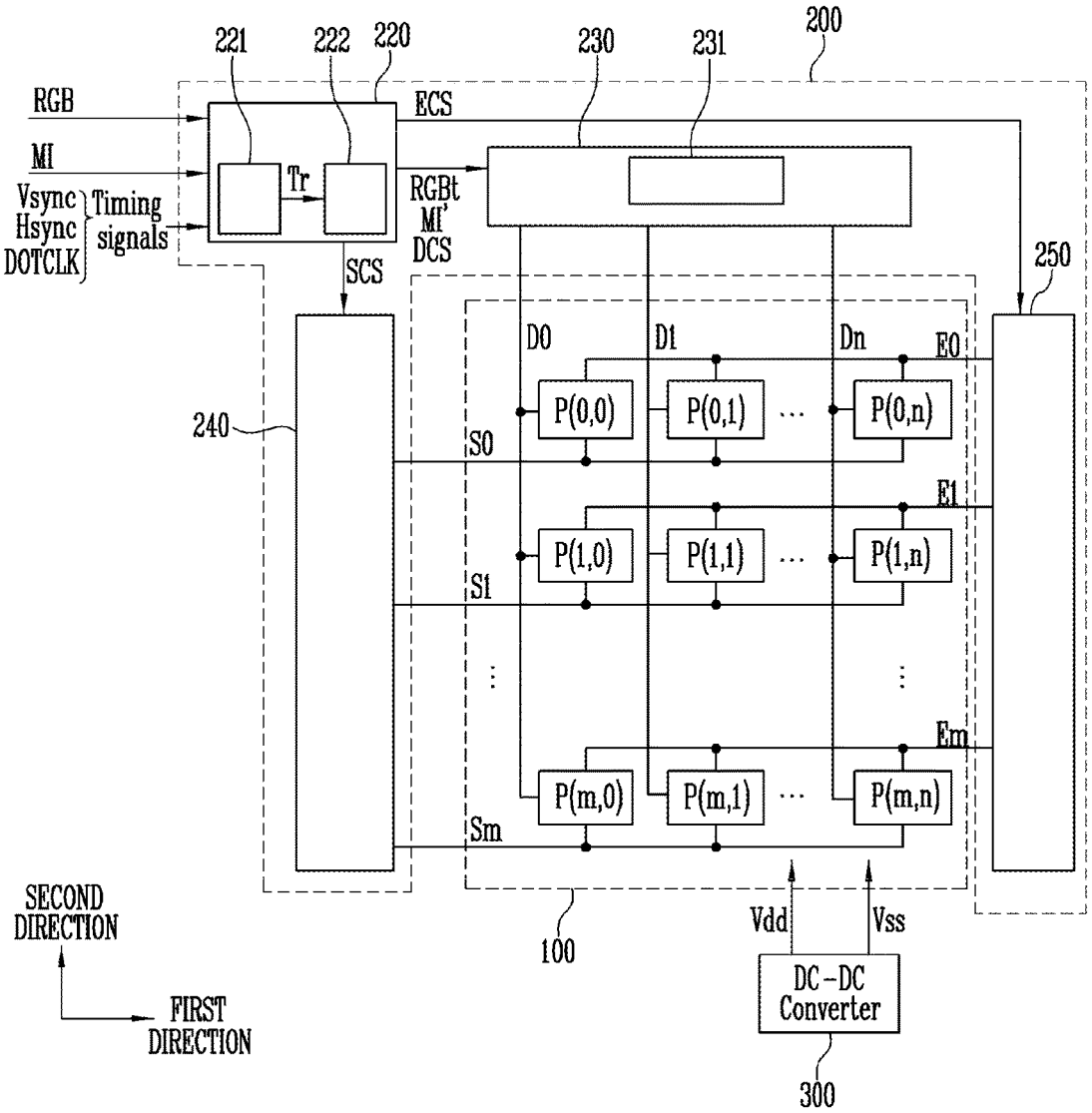
FIG. 1 is a view of an organic light emitting display device according to an embodiment of the present invention.

Hereinafter, embodiments of the present invention will be described in detail with reference to the accompanying drawings. Like reference numerals refer to like elements throughout. In describing the present invention, when a detailed description of a well-known function or configuration related to the present invention is considered to unnecessarily divert the gist of the present invention, the detailed description will not be given. Names of elements used in the following description are selected for the description purposes only, and may be different from those of actual products. All numerical values are approximate, and may vary. All examples of specific materials and compositions are to be taken as nonlimiting and exemplary only. Other suitable materials and compositions may be used instead.

FIG. 1 is a view of an organic light emitting display device according to an embodiment of the present invention. The organic light emitting display device includes a display panel 100, a display panel driver 200, and a power source supplier 300.

The display panel 100 includes pixels P(0,0) to P(m,n) (m and n are positive integers), data lines D0 to Dn (hereinafter, referred to as D) extending in a second direction, for transmitting data voltages to the pixels P(0,0) to P(m,n), and scan lines S0 to Sm (hereinafter, referred to as S) extending in a first direction, for transmitting scan signals to the pixels P. According to the embodiment, the display panel 100 may further include emission control lines E0 to Em (hereinafter, referred to as E) extending in the first direction, for transmitting emission control signals to the pixels P. In this embodiment, (n+1) pixels P are arranged in the first direction and (m+1) pixels P are arranged in the second direction. The scan lines S extend in the first direction and the data lines D extend in the second direction which intersects the first direction. However, the present invention is not limited thereto. In addition, power source lines for driving the pixels P are omitted, and a structure of each of the pixels P will be described in detail with reference to FIG. 2. In FIG. 1, a pixel (a,b) (a is an integer of value no less than 0 and no more than m, and b is an integer of value no less than 0 and no more than n) is electrically connected to a scan line Sa, an emission control line Ea, and a data line Db. However, the present invention is not limited thereto. In addition, according to the embodiment, the pixel P(a,b) may be electrically connected to a scan line Sa-1.

The display panel driver 200 drives the display panel 100 by generating data voltages and supplying the generated data voltages to the data lines D, and by generating scan signals and supplying the generated scan signals to the scan lines S. More specifically, the display panel driver 200 includes a timing controller 220, a data driver 230, a scan driver 240, and an emission control driver 250. The timing controller 220, the data driver 230, the scan driver 240, and the emission control driver 250 may be respectively implemented by electronic devices or the entire display panel driver 200 may be implemented by one electronic device (for example, a display driving integrated circuit (IC), etc.).

The timing controller 220 receives image signals RGB, timing signals, and a maximum brightness signal MI from an external source. One image signal RGB(a,b) of the image signals RGB corresponds to the pixel P(a,b) and a grayscale corresponding to the pixel P(a,b) is determined based on a level of the image signal RGB(a,b). The grayscale may have a value between 0 and 255. The grayscale 0 may be referred to as a black grayscale, and the grayscale 255 may be referred to as a white grayscale. The timing signals include a vertical synchronizing signal Vsync, a horizontal synchronizing signal Hsync, and dot clocks DOTCLK. The maximum brightness may be determined based on the maximum brightness signal MI. Timing control signals DCS and SCS for controlling operation timing of the data driver 230 and the scan driver 240 are generated based on the received timing signals. When the maximum brightness is higher than a first reference maximum brightness Imaxref1 and lower than a second reference maximum brightness Imaxref2, the timing controller 220 generates an emission control timing control signal ECS including information on a non-emission period. When the maximum brightness is lower than the first reference maximum brightness Imaxref1 or higher than the second reference maximum brightness Imaxref2, the timing controller 220 generates an emission control timing control signal ECS that does not include information on the non-emission period. In another embodiment, when the maximum brightness is lower than the second reference maximum brightness Imaxref2, the timing controller 220 may generate an emission control timing control signal ECS that does not include information on the non-emission period.

In addition, the timing controller 220 includes a whether to convert signal generator 221 and an image signal converter 222. The whether to convert signal generator 221 generates a whether to convert signal Tr. When the maximum brightness is lower than the first reference maximum brightness Imaxref1, the whether to convert signal generator 221 generates a whether to convert signal Tr having a first logic value. When the maximum brightness is higher than the first reference maximum brightness Imaxref1, the whether to convert signal generator 221 generates a whether to convert signal Tr having a second logic value different from the first logic value. The generated whether to convert signal Tr is transmitted to the image signal converter 222. When a whether to convert signal Tr having the first logic value is received, the image signal converter 222 converts the image signals RGB to converted image signals RGBt, and the timing controller 220 outputs converted image signals RGBt. When a whether to convert signal Tr having the second logic value is received, the image signal converter 222 does not convert the image signals RGB, and the timing controller 220 outputs the image signals RGB.

When the timing controller 220 converts the image signals RGB or generates the emission control timing control signal ECS including information on the non-emission period, the timing controller 220 converts the maximum brightness and generates a maximum brightness signal MI' based on the converted maximum brightness. For example, when the maximum brightness is lower than the first reference maximum brightness Imaxref1, the level of the maximum brightness is converted so that average brightness of pixels in the case in which the image signals RGB are displayed based on the maximum brightness is substantially equal to average brightness of pixels in the case in which the converted image signals RGBt are displayed based on the converted maximum brightness, which will be described in detail with reference to FIG. 5. In addition, when the maximum brightness is higher than the first reference maximum brightness Imaxref1 and is lower than the second reference maximum brightness Imaxref2, the level of the maximum brightness is converted so that average brightness of pixels in the case in which the image signals RGB are displayed based on the maximum brightness and an emission control timing control signal ECS that does not include information on the non-emission period is substantially equal to average brightness of pixels in the case in which the image signals RGB are displayed based on the converted maximum brightness and an emission control timing control signal ECS including information on the non-emission period, which will be described with reference to FIG. 4. In FIG. 1, the timing controller 220 outputs the converted maximum brightness signal MI' and the converted image signals RGBt. However, the present invention is not limited thereto. When the maximum brightness is higher than the second reference maximum brightness Imaxref2, the timing controller 220 may for example output the maximum brightness signal MI and the image signals RGB.

The data driver 230 latches the image signals RGB or the converted image signals RGBt input from the timing controller 220, in response to the data timing control signal DCS. The data driver 230 includes a plurality of source driver ICs and the source driver ICs may be electrically connected to the data lines D of the display panel 100 by a chip on glass (COG) process or a tape automated bonding (TAB) process. The data driver 230 further includes a maximum brightness look-up table 231. When the maximum brightness and a grayscale are input, the maximum brightness look-up table 231 may output a data voltage level based on the input maximum brightness and grayscale. When the maximum brightness determined based on the maximum brightness signal MI is higher than the second reference maximum brightness Imaxref2, the maximum brightness is input to the maximum brightness look-up table 231 as is. When the maximum brightness determined based on the maximum brightness signal MI is lower than the second reference maximum brightness Imaxref2, the maximum brightness converted by the timing controller 220 is input to the maximum brightness look-up table 231. In FIG. 1, the maximum brightness look-up table 231 is included in the data driver 230. However, the present invention is not limited thereto. The maximum brightness look-up table 231 may instead for example be included in the timing controller 220, and/or the maximum brightness look-up table 231 may be stored in an additional non-volatile memory (not shown).

The scan driver 240 sequentially supplies the scan signals to the scan lines S in response to the scan timing control signal SCS. The scan driver 240 is directly formed on a substrate of the display panel 100 in a gate in panel (GIP) method, or may be electrically connected to the scan lines S of the display panel 100 by a tablature (TAB) method.

The emission control driver 250 sequentially supplies emission control signals to emission control lines E in response to the emission control timing control signal ECS. The emission control driver 250 is directly formed on the substrate of the display panel 100 by the GIP method, or may be electrically connected to the emission control lines E of the display panel 100 via the TAB method.

The power source supplier 300 supplies a first voltage Vdd and a second voltage Vss to the display panel 100. In the above, it is described that, when the maximum brightness is higher than the first reference maximum brightness Imaxref1 and is lower than the second reference maximum brightness Imaxref2, the emission control timing control signal ECS is generated so as to include information on the non-emission period. However, the present invention is not limited thereto. The power source supplier 300 may be controlled so as not to supply the first voltage Vdd and the second voltage Vss during part of one frame. This can be accomplished by the timing controller 220 transmitting a power source supplier control signal (not shown) to the power source supplier 300. In addition, the power source supplier 300 may further supply an initializing voltage to the display panel 100 according to the embodiment. A level of the first voltage Vdd may be higher than that of the second voltage Vss.

When the display panel 100 is driven by generating an emission control timing control signal ECS including information on the non-emission period, since additional information on brightness correction is required, a size of the maximum brightness look-up table 231 increases. However, when the maximum brightness is lower than the first reference maximum brightness Imaxref1, the timing controller 220 generates the converted image signals RGBt instead of generating an emission control timing control signal ECS that does not include information on the non-emission period. Therefore, a degree of increase in size of the look-up table required for increasing the possible maximum brightness steps may be minimized.

Figure 2:
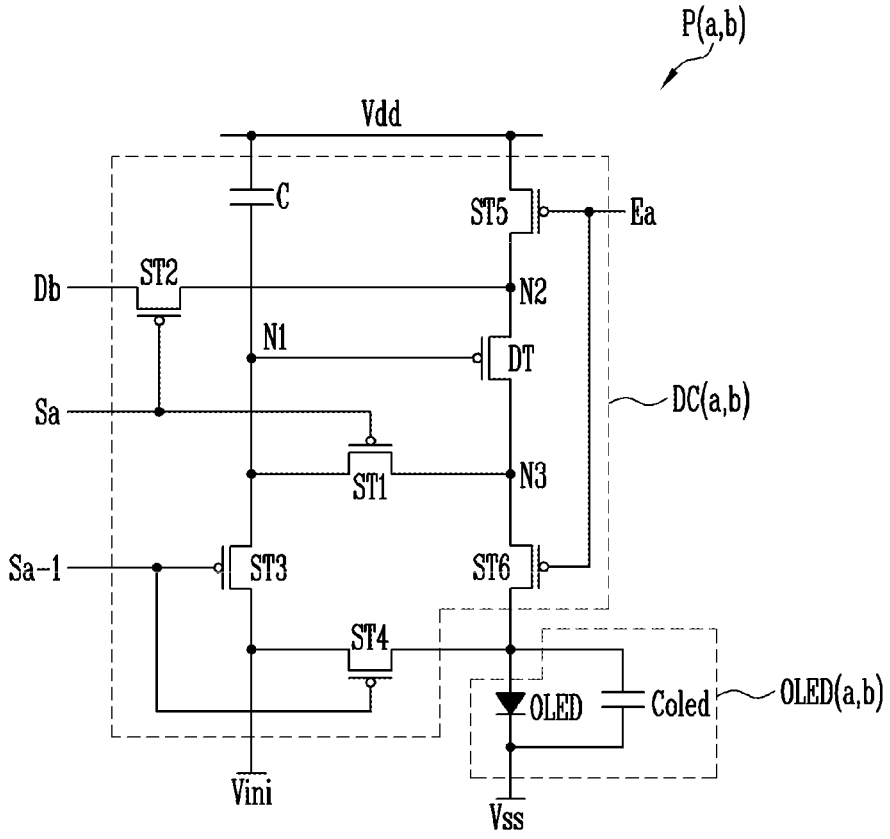
FIG. 2 is a view of an embodiment of a pixel in the organic light emitting display device of FIG. 1.

FIG. 2 is a view of an embodiment of a pixel in the organic light emitting display device of FIG. 1. For convenience, only a single pixel P(a,b) will be described.

The pixel P(a,b) includes an organic light emitting diode (OLED) OLED(a,b) and a pixel driving circuit DC(a,b). The pixel driving circuit DC(a,b) outputs a driving current to the OLED OLED(a,b). The pixel driving circuit DC(a,b) includes a driving transistor DT, first to sixth transistors ST1 to ST6, and a capacitor C. The driving transistor DT and the first to sixth transistors ST1 to ST6 may be p-type transistors. However, the present invention is not limited thereto.

A gate electrode of the driving transistor DT is electrically connected to a first node N1, a first electrode of the driving transistor DT is electrically connected to a second node N2, and a second electrode of the driving transistor DT is electrically connected to a third node N3. The driving transistor DT controls a drain-source current based on a difference in voltage level between the gate electrode thereof and the first electrode thereof, and a current level of the drain-source current $I_{ds}$ corresponds to a current level of the driving current. Here, the first electrode may be a source electrode or a drain electrode, and the second electrode may be an electrode different from the first electrode. For example, when the first electrode is the source electrode, the second electrode may be the drain electrode. Definitions of the first electrode and the second electrode may be also applied to the first to sixth transistors ST1 to ST6 to be described hereinafter.

A gate electrode of the first transistor ST1 is electrically connected to an ath scan line Sa, a first electrode of the first transistor ST1 is electrically connected to the third node N3, and a second electrode of the first transistor ST1 is electrically connected to the first node N1. When the first transistor ST1 is turned on by a scan signal of the ath scan line Sa, the driving transistor DT is diode-connected.

A gate electrode of the second transistor ST2 is electrically connected to the ath scan line Sa, a first electrode of the second transistor ST2 is electrically connected to a bth data line Db, and a second electrode of the second transistor ST2 is electrically connected to the second node N2. When the second transistor ST2 is turned on by the scan signal of the ath scan line Sa, a voltage level of the second node N2 corresponds to a voltage level of the data line Db.

A gate electrode of the third transistor ST3 is electrically connected to an (a-1)th scan line Sa-1, a first electrode of the third transistor ST3 is electrically connected to the first node N1, and an initializing voltage Vini is supplied to a second electrode of the third transistor ST3. When a scan signal is supplied to the (a-1)th scan line Sa-1, the initializing voltage Vini is supplied to the first node N1.

A gate electrode of the fourth transistor ST4 is electrically connected to the (a-1)th scan line Sa-1, the initializing voltage Vini is supplied to a first electrode of the fourth transistor ST4, and a second electrode of the fourth transistor ST4 is electrically connected to an anode electrode of the OLED OLED(a,b). When the scan signal is supplied to the (a-1)th scan line Sa-1, the initializing voltage Vini is supplied to the anode electrode of the OLED OLED(a,b).

A gate electrode of the fifth transistor ST5 is electrically connected to an ath emission line Ea, a first voltage Vdd is supplied to a first electrode of the fifth transistor ST5, and a second electrode of the fifth transistor ST5 is electrically connected to the second node N2. When an emission signal is supplied to the ath emission line Ea, the first voltage Vdd is supplied to the second node N2.

A gate electrode of the sixth transistor ST6 is electrically connected to the ath emission line Ea, a first electrode of the sixth transistor ST6 is electrically connected to the third node N3, and a second electrode of the sixth transistor ST6 is electrically connected to the anode electrode of the OLED OLED(a,b). The fifth and sixth transistors ST5 and ST6 are turned on by the emission signal of the ath emission line Ea, so that the drain-source current $I_{ds}$ of the driving transistor DT is supplied to the OLED OLED(a,b) as its driving current.

One end of the capacitor C is electrically connected to the first node N1, the first voltage Vdd is supplied to the other end of the capacitor C, and the capacitor C maintains a voltage level of the first node N1.

The OLED OLED(a,b) emits light when a current is received. The OLED OLED(a,b) may be modeled by using an ideal OLED and ideal capacitance COLED. A current level of the current supplied to the OLED OLED(a,b) corresponds to the current level of the drain-source current $I_{ds}$ of the driving transistor DT. The current level of the drain-source current $I_{ds}$ of the driving transistor DT may be defined by Equation 1.

$$I_{ds}=k(V_{gs}-V_{th})^2 \quad \text{[EQUATION 1]}$$

In Equation 1, k is a proportional coefficient determined by a structure and a physical characteristic of the driving transistor DT, $V_{gs}$ refers to the gate-source voltage of the driving transistor DT, and $V_{th}$ refers to the threshold voltage of the driving transistor DT.

Figure 3:
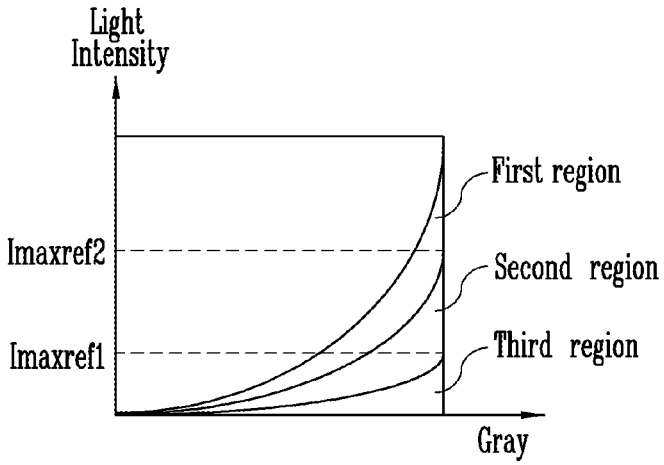
FIG. 3 is a graph illustrating part of a method of driving the organic light emitting display device of FIG. 1 based on maximum brightness.

FIG. 3 is a graph illustrating part of a method of driving the organic light emitting display device of FIG. 1 based on maximum brightness. Referring to FIG. 3, when the maximum brightness is higher than the second reference maximum brightness Imaxref2, it may be determined that the maximum brightness falls within a first region. When the maximum brightness is higher than the first reference maximum brightness Imaxref1 but lower than the second reference maximum brightness Imaxref2, it may be determined that the maximum brightness falls within a second region. When the maximum brightness is lower than the first reference maximum brightness Imaxref1, it may be determined that the maximum brightness falls within a third region. When the maximum brightness lies in the first region, the maximum brightness is input to the maximum brightness look-up table 231 as is. The timing controller 220 outputs the image signals RGB as is, and generates an emission control timing control signal ECS that does not include information on the non-emission period. The maximum brightness signal MI is output as is. When the maximum brightness lies in the second region or the third region, the maximum brightness is converted by the timing controller 220. When the maximum brightness lies in the second region, the timing controller 220 may generate an emission control timing control signal ECS that includes information on the non-emission period, and may output the image signals RGB as they are. When the maximum brightness lies in the third region, the timing controller 220 may convert the image signals RGB into the converted image signals RGBt. In the embodiment, when the maximum brightness lies in the third region, the timing controller 220 may generate an emission control timing control signal ECS that either does or does not include information on the non-emission period.

Figure 4:
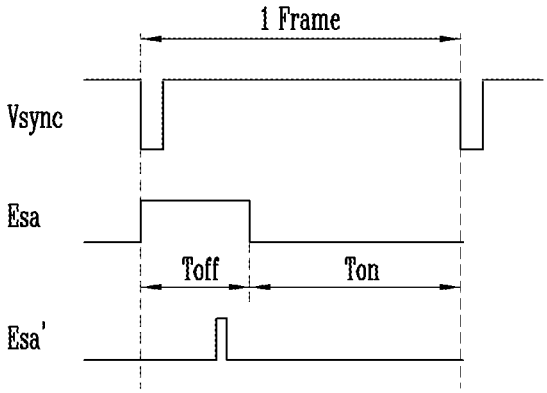
FIG. 4 is a timing diagram illustrating emission of light components when the maximum brightness of the organic light emitting display device of FIG. 1 is included in a second region.

FIG. 4 is a view of a method of pixels emitting light components when the maximum brightness of the organic light emitting display device of FIG. 1 is included in a second region.

Referring to FIG. 4, a vertical synchronizing signal Vsync is supplied once in a single frame 1 Frame. During this 1 Frame, an emission control signal Esa is supplied to the ath emission control line Ea when the emission control timing control signal ECS includes information on the non-emission period. Conversely, emission control signal Esa' supplied to the emission control line Ea when the emission control timing control signal ECS does not include information on the non-emission period. A length of the one frame 1 Frame may be determined by a driving frequency of the display panel 100. For example, when the driving frequency is 60 Hz, 1 Frame may be 16.66 milliseconds long.

The emission control signal Esa is at a high level in a non-emission period Toff of 1 Frame, and is at a low level in an emission period Ton of 1 Frame. In the non-emission period Toff, since the emission control signal Esa is at the high level, the fifth transistor ST5 and the sixth transistor ST6 are turned off. Since a current does not flow to the OLED OLED(a,b), the pixel P(a,b) does not emit light. In the emission period Ton, since the emission control signal Esa is at the low level, the fifth transistor ST5 and the sixth transistor ST6 are turned on. Since the current may flow to the OLED OLED(a,b), the pixel P(a,b) may emit light. A length of the non-emission period Toff may be determined by the timing controller 220 in the range of 2% to 20% of the one frame 1 Frame.

The emission control signal Esa' is at a low level during most of 1 Frame and is at a high level only in a very short period. The period in which the emission control signal Esa' is at the high level is very short and may be disregarded for the purposes herein.

When the maximum brightness determined by the maximum brightness signal MI falls within the second region, the emission control timing control signal ECS includes information on the non-emission period, and the maximum brightness is converted. At this time, the converted maximum brightness is defined by the following equation.

$$I'_{max} = I_{max} \times \left(1 + \frac{toff}{ton}\right) \quad \text{[EQUATION 2]}$$

Here, $I_{max}$ refers to the maximum brightness, $I_{max}'$ refers to the converted maximum brightness, toff refers to the length of the non-emission period, and ton refers to the length of the emission period.

For example, when ton:toff=0.8:0.2, the converted maximum brightness $I_{max}'$ is 1.25 times the maximum brightness $I_{max}$. Average brightness in one frame is $I_{max}$ when light is emitted in the one frame 1 Frame with the maximum brightness $I_{max}$. Average brightness in one frame is also $I_{max}$, when light is emitted during 80% of (0.8 times) 1 Frame (0.8 Frame) with the converted maximum brightness 1.25 $I_{max}$. Therefore, although the maximum brightness is converted by the equation 2, the average brightness of the pixels is not converted, i.e. unchanged.

Figure 5:
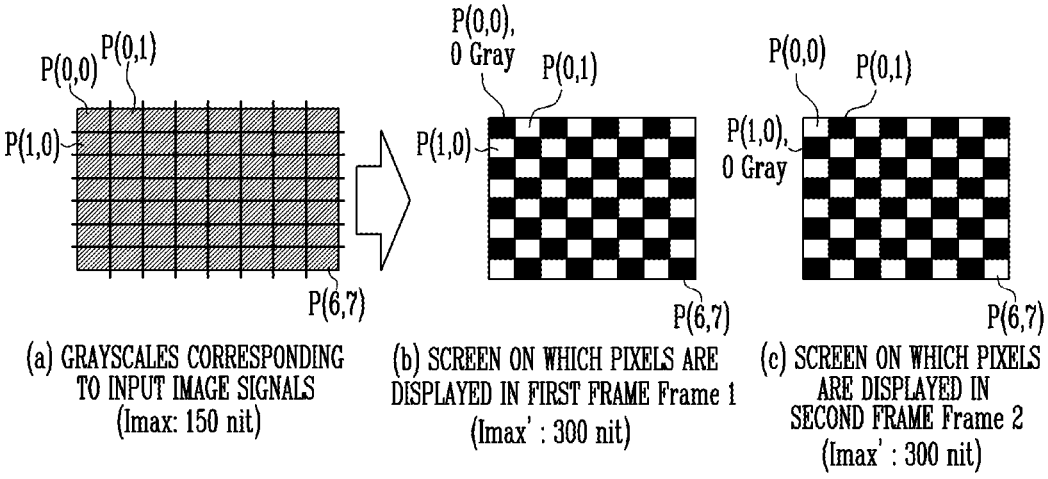
FIG. 5 illustrates a method of emitting light components when the maximum brightness of the organic light emitting display device of FIG. 1 is included in a third region.

FIG. 5 illustrates emission of light components in a display when the maximum brightness of the organic light emitting display device of FIG. 1 falls within the third region. For convenience of explanation, among the pixels P, only pixels P(0,0) to P(6,7) will be described.

FIG. 5A is a view illustrating a case in which the maximum brightness $I_{max}$=150 nit and the image signals RGB are not converted, so that all the pixels P emit light. It is assumed that grayscales corresponding to the pixels P(0,0) to P(6,7) are white ones and are maintained to be the same in no less than two frames.

FIG. 5B is a view illustrating values actually displayed by the pixels P(0,0) to P(6,7) in a first frame Frame 1 for the image of FIG. 5A. When the driving frequency of the organic light emitting display device is 60 Hz, the first frame Frame 1 is displayed for 1/60 seconds.

In the first frame Frame 1, when a+b of the pixel P(a,b) is an even number, the image signal RGB(a,b) corresponding to the pixel P(a,b) is converted so as to correspond to the black grayscale. For example, since a+b is 0 (i.e. an even number) in the pixel P(0,0), an image signal RGB(0,0) is converted to correspond to the black grayscale. Since a+b is 1 (i.e. an odd number) in a pixel P(0,1) and a pixel P(1,0) adjacent to the pixel P(0,0) in a first or second direction, an image signal RGB(0,1) and an image signal RGB(1,0) are not converted to correspond to the black grayscale. The converted maximum brightness $I_{max}'$ is 300 nit, that is, two times the maximum brightness $I_{max}$.

FIG. 5C is a view illustrating values actually displayed by the pixels P(0,0) to P(6,7) in a second frame Frame 2 for the image of FIG. 5A. It may be assumed that the second frame Frame 2 is displayed immediately after the first frame Frame 1. That is, in order to display the image of FIG. 5A, two frames Frame 1 and Frame 2 are successively displayed instead. In the second frame Frame 2, when a+b of the pixel P(a,b) is an odd number, the image signal RGB(a,b) corresponding to the pixel P(a,b) is converted so as to correspond to the black grayscale. For example, since a+b is 1 is an odd number in the pixel P(0,1) and the pixel P(1,0), the image signal RGB(0,1) and the image signal RGB(1,0) are converted to correspond to the black grayscale. Since a+b is 0 (i.e. an even number) in the pixel P(0,0), the image signal RGB(0,0) is not converted to correspond to the black grayscale. The converted maximum brightness $I_{max}'$ is 300 nit, that is, two times the maximum brightness $I_{max}$.

The case in which the maximum brightness $I_{max}$ is 150 nit in two frames as illustrated in FIG. 5A will be compared with the case in which the converted maximum brightness $I_{max}'$ is 300 nit in two frames as illustrated in FIGS. 5B and 5C. When the maximum brightness $I_{max}$ is 150 nit in two frames as illustrated in FIG. 5A, the average brightness of the pixels in the two frames is 150 nit. When the each of the pixels P(0,0) to P(6,7) emit light components only in one frame of two successive frames instead, the converted maximum brightness $I_{max}'$ is 300 nit in the two frames as illustrated in FIGS. 5B and 5C, the brightness in one period of the first frame Frame 1 and the second frame Frame 2 is 300 nit and brightness in the other period is 0 nit. Therefore, the average brightness of the pixels in the two frames is (300+0)/2=150 nit. Thus, a difference between the case in which the maximum brightness $I_{max}$ is set as 150 nit in the two frames as illustrated in FIG. 5A, and the case in which the pixels P(0,0) to P(6,7) emit light components only every other frame but the converted maximum brightness $I_{max}'$ is set to be two times the maximum brightness $I_{max}$ as illustrated in FIGS. 5B and 5C, is not recognized by viewers.

In general, the converted maximum brightness is determined by the following equation.

$$I'_{max} = I_{max} \times \left(\frac{t}{ton}\right) \quad \text{[EQUATION 3]}$$

Here, $I_{max}$ refers to the maximum brightness, $I_{max}'$ refers to the converted maximum brightness, t is a period, and ton is a length of an emission period of the period t.

Specifically, in the embodiment described with reference to FIG. 5, the period t is two frames and the length ton of the emission period of t is one frame. Therefore, when the converted maximum brightness $I_{max}'$ is two times the maximum brightness $I_{max}$, although the maximum brightness $I_{max}$ is converted, the average brightness of the pixels is not converted i.e. remains the same.

When the image signals RGB are converted into the converted image signals RGBt and the emission control timing control signal ECS includes information on the non-emission period, the maximum brightness $I_{max}$ is converted by the following equation.

$$I'_{max} = I_{max} \times \left(1 + \frac{toff}{ton}\right) \times \left(\frac{t'}{ton'}\right) \quad \text{[EQUATION 4]}$$

Here, $I_{max}$ is the maximum brightness, $I_{max}'$ is the converted maximum brightness, toff is a length of a non-emission period in one frame, ton is a length of an emission period in one frame, t' refers to a period, and ton' refers to a length of an emission period of the period t'.

Figure 6:
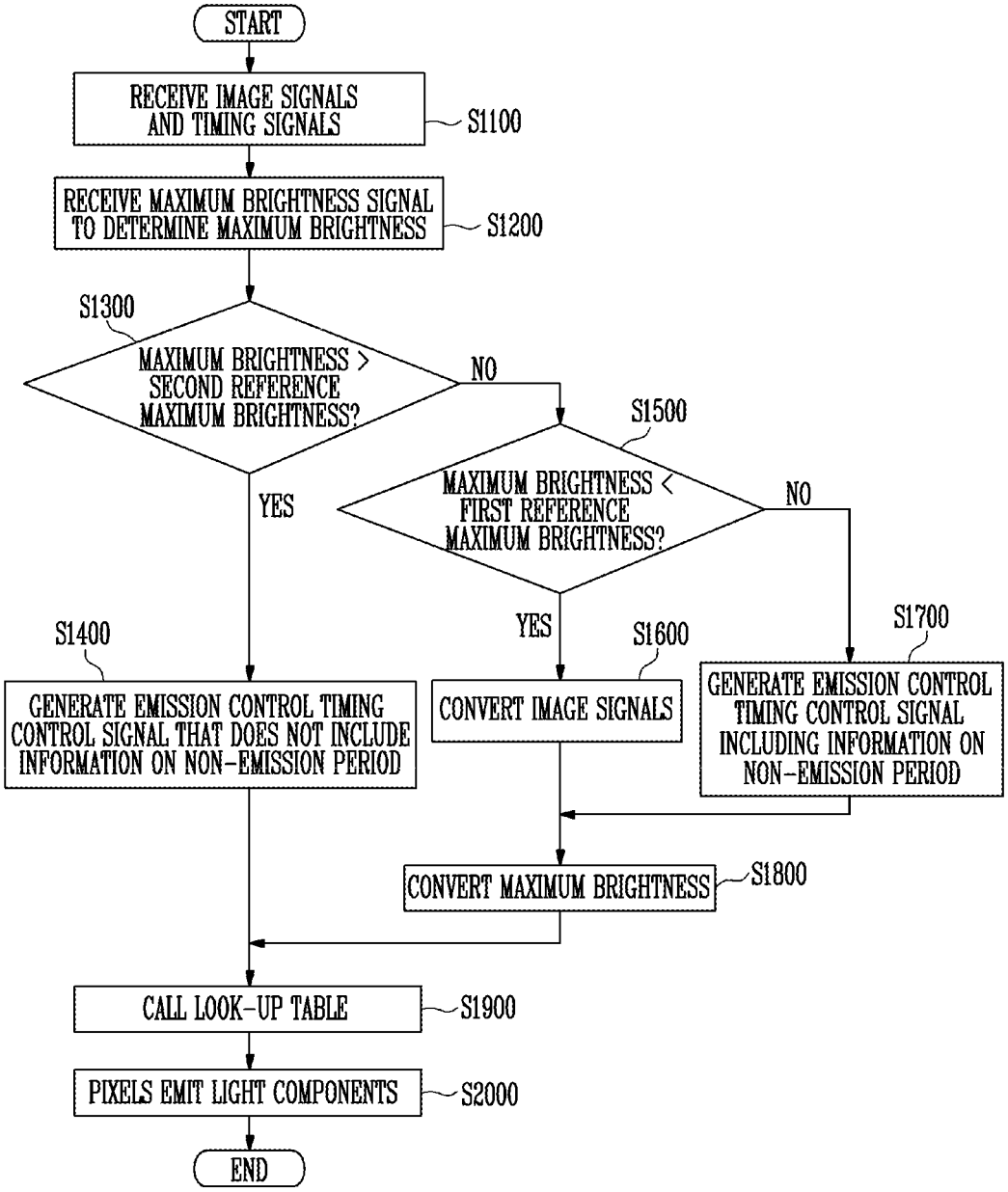
FIG. 6 is a flowchart describing a method of driving an organic light emitting display device according to an embodiment of the present invention.

FIG. 6 is a flowchart illustrating a method of driving an organic light emitting display device according to an embodiment of the present invention. In the method of driving the organic light emitting display device described with reference to FIG. 6, when the maximum brightness $I_{max}$ falls within the third region, the emission control timing control signal ECS does not include the information on the non-emission period, which will be described with reference to FIGS. 1 to 6.

In operation S1100, the timing controller 220 receives the image signals RGB and the various timing signals described above. Since the operation S1100 is performed by common display devices, detailed description thereof is not presented here.

In operation S1200, the timing controller 220 receives the maximum bright signal MI and determines the maximum brightness $I_{max}$ based on the maximum bright signal MI. In FIG. 6, the operation S1200 is performed after the operation S1100. However, the present invention is not limited thereto. The operation S1100 may be performed after the operation S1200, or the operation S1100 and the operation S1200 may be simultaneously performed.

In operation S1300, the maximum brightness $I_{max}$ is compared with the second reference maximum brightness Imaxref2. When the maximum brightness $I_{max}$ is higher than the second reference maximum brightness Imaxref2, operation S1400 is performed. When the maximum brightness $I_{max}$ is lower than or equal to the second reference maximum brightness Imaxref2, operation S1500 is performed instead.

In operation S1400, since the maximum brightness $I_{max}$ is higher than the second reference maximum brightness Imaxref2, the timing controller 220 does not convert the image signals RGB, and generates an emission control timing control signal ECS that does not include information on the non-emission period.

In operation S1500, the maximum brightness $I_{max}$ is compared with the first reference maximum brightness Imaxref1. When the maximum brightness $I_{max}$ is lower than the first reference maximum brightness Imaxref1, operation S1600 is performed. When the maximum brightness $I_{max}$ is greater than or equal to the first reference maximum brightness Imaxref1, operation S1700 is performed instead.

In operation S1600, since the maximum brightness $I_{max}$ is lower than the first reference maximum brightness Imaxref1, the timing controller 220 converts the image signals RGB. In the operation S1600, the converted image signals RGBt are generated. In addition, in this embodiment, since the maximum brightness $I_{max}$ does not fall within the second region, the timing controller 220 generates an emission control timing control signal ECS that does not include information on the non-emission period.

In operation S1700, the timing controller 220 generates an emission control timing control signal ECS that includes information on the non-emission period.

In operation S1800, the maximum brightness $I_{max}$ is converted. When the maximum brightness $I_{max}$ falls within the second region, the converted maximum brightness $I_{max}'$ is determined based on Equation 2 and, when the maximum brightness $I_{max}$ lies within the third region, the converted maximum brightness $I_{max}'$ is determined based on Equation 3.

In operation 1900, the maximum brightness look-up table 231 is called. The maximum brightness $I_{max}$ is input when the maximum brightness $I_{max}$ falls within the first region, and the converted maximum brightness $I_{max}'$ is input when the maximum brightness $I_{max}$ falls within the second region or the third region. Then, when grayscales corresponding to the image signals RGB are input, the maximum brightness look-up table 231 outputs data voltage levels corresponding to the input grayscales.

In operation S2000, the pixels P emit light components. When the maximum brightness $I_{max}$ lies within the first region, the pixels P emit light components based on the maximum brightness $I_{max}$, an emission control timing control signal ECS that does not include information on the non-emission period, and the image signals RGB. When the maximum brightness $I_{max}$ lies within the second region, the pixels P emit light components based on the converted maximum brightness $I_{max}$, an emission control timing control signal ECS including information on the non-emission period, and the image signals RGB. When the maximum brightness $I_{max}$ lies within the third region, the pixels P emit light components based on the converted maximum brightness $I_{max}'$, an emission control timing control signal ECS that does not include information on the non-emission period, and the converted image signals RGBt.

Figure 7:
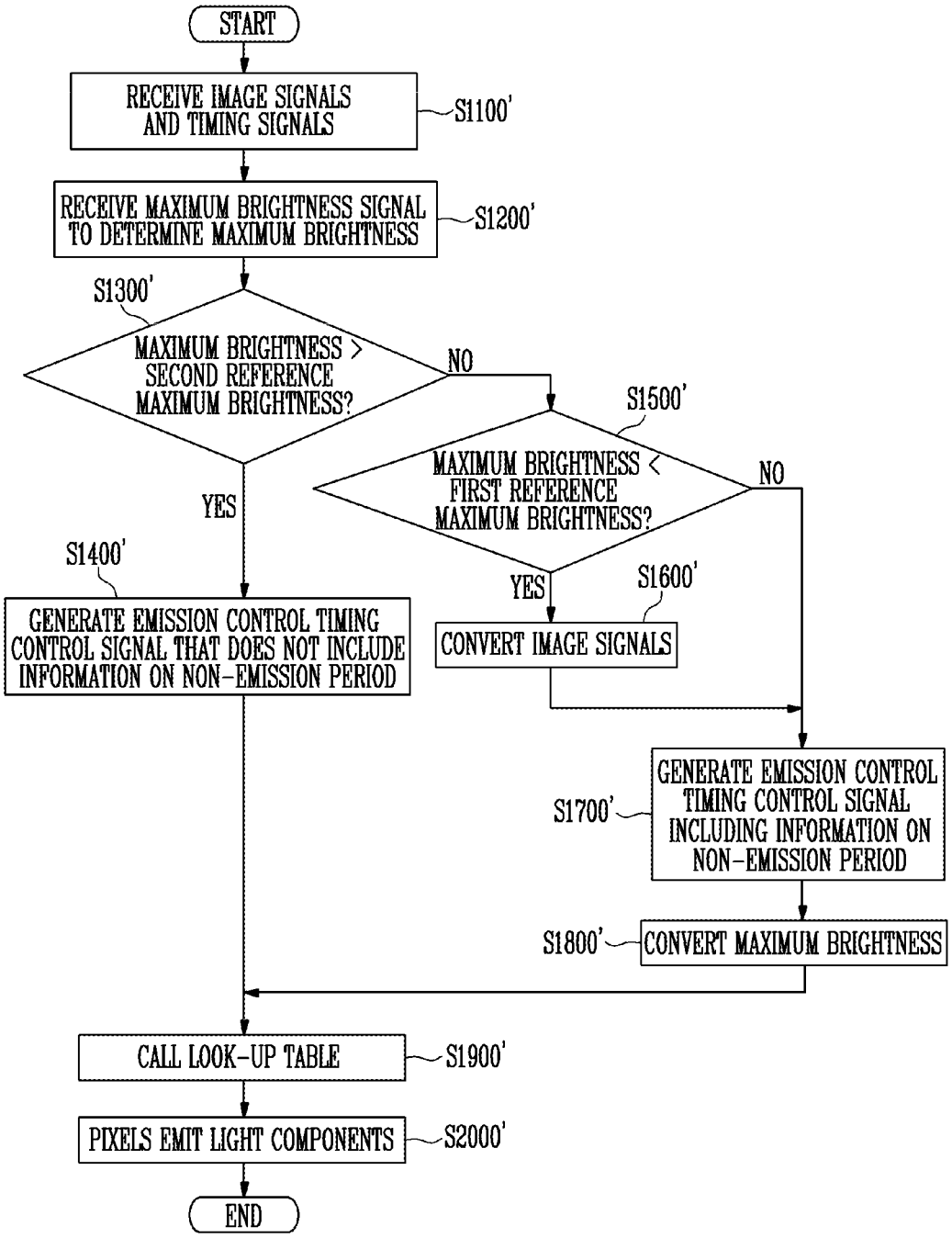
FIG. 7 is a flowchart describing a method of driving an organic light emitting display device according to another embodiment of the present invention.

FIG. 7 is a flowchart illustrating a method of driving an organic light emitting display device according to another embodiment of the present invention. In the method of driving the organic light emitting display device described with reference to FIG. 7, when the maximum brightness $I_{max}$ corresponds to the third region, an emission control timing control signal ECS including information on the non-emission period is generated, which will be described with reference to FIGS. 1 to 7.

Since operations S1100', S1200', S1300', S1400', S1500', and S1900' are the same as the operations S1100, S1200, S1300, S1400, S1500, and S1900, detailed description thereof will not be given.

In operation S1600', since the maximum brightness $I_{max}$ is lower than the first reference maximum brightness Imaxref1, the timing controller 220 converts the image signals RGB. In the operation S1600', the converted image signals RGBt are generated. After the operation S1600', operation S1700' is performed.

In the operation S1700', the timing controller 220 generates emission control timing control signal ECS which includes information on the non-emission period. When the maximum brightness $I_{max}$ is lower than the second reference maximum brightness Imaxref2, the timing controller 220 generates an emission control timing control signal ECS that does not include information on the non-emission period. That is, when the maximum brightness $I_{max}$ falls within the second region or the third region, the timing controller 220 generates a emission control timing control signal ECS that includes information on the non-emission period.

In operation S1800', the maximum brightness $I_{max}$ is converted. When the maximum brightness $I_{max}$ lies within the second region, the converted maximum brightness $I_{max}'$ is determined based on Equation 2 and, when the maximum brightness $I_{max}$ lies within the third region, the converted maximum brightness $I_{max}'$ is determined based on Equation 4.

In operation S2000', the pixels P emit light components. When the maximum brightness $I_{max}$ falls within the first region, the pixels P emit light components based on the maximum brightness $I_{max}$, an emission control timing control signal ECS that does not include information on the non-emission period, and the image signals RGB. When the maximum brightness $I_{max}$ falls within the second region, the pixels P emit light components based on the converted maximum brightness $I_{max}'$, an emission control timing control signal ECS including information on the non-emission period, and the image signals RGB. When the maximum brightness $I_{max}$ falls within the third region, the pixels P emit light components based on the converted maximum brightness $I_{max}$, an emission control timing control signal ECS including information on the non-emission period, and the converted image signals RGBt.

Figure 8:
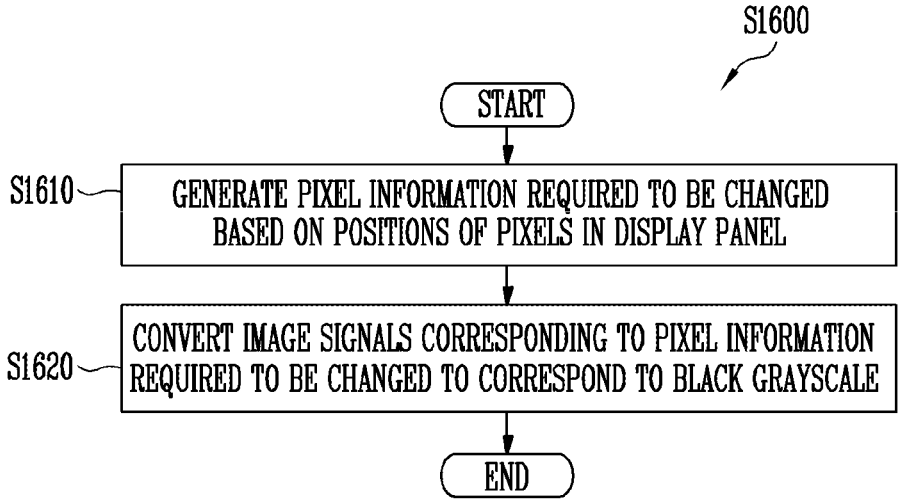
FIG. 8 is a flowchart illustrating further details of conversion of image signals, in the method of driving an organic light emitting display device of FIG. 6.

FIG. 8 is a view illustrating processes of converting image signals, in the method of driving an organic light emitting display device of FIG. 6.

In operation S1610, pixel information required to be changed is generated based on positions of the pixels in the display panel. For example, when a+b of the pixel P(a,b) is an even number in the first frame Frame 1, the pixel P(a,b) is included in the pixel information to be changed.

In operation S1620, image signals corresponding to the pixel information that is to be changed are converted to correspond to the black grayscale. For example, the image signal RGB(a,b) corresponding to the pixel P(a,b) in which a+b is an even number is converted to correspond to the black grayscale in the first frame Frame 1. The result of operation S1620 is the converted image signals RGBt.

Figure 9:
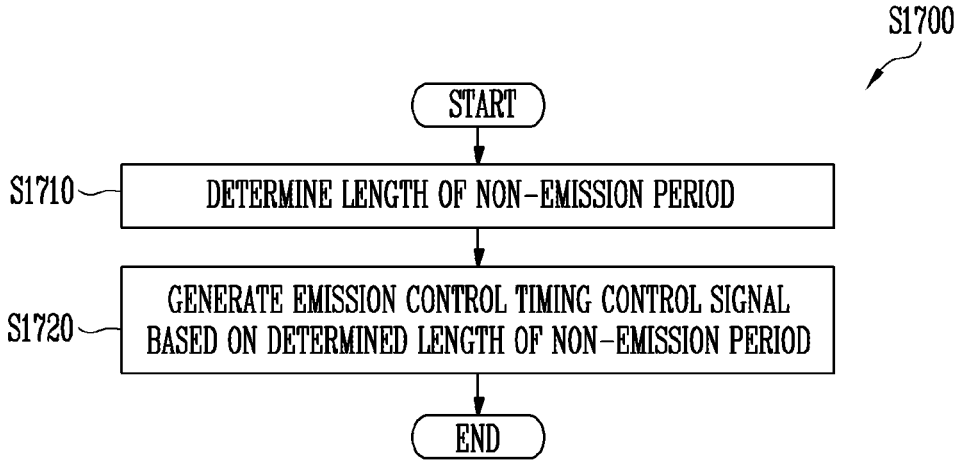
FIG. 9 is a flowchart illustrating further details of generation of an emission control timing control signal including information on a non-emission period, in the method of driving an organic light emitting display device of FIG. 6.

FIG. 9 is a view illustrating processes of generating an emission control timing control signal including information on a non-emission period, in the method of driving an organic light emitting display device of FIG. 6.

In operation S1710, the length of the non-emission period toff is determined. The non-emission period toff may be determined based on the maximum brightness $I_{max}$. According to Equation 2, when the converted maximum brightness $I_{max}'$ is required to be 1.25 times the maximum brightness $I_{max}$ ($I_{max}'=1.25I_{max}$), Ton:Toff has to be 0.8:0.2. Therefore, Toff is 20% of a frame period.

In operation S1720, the timing controller 220 generates the emission control timing control signal ECS based on the determined length of the non-emission period toff. A length of the non-emission period Toff can correspond to a length of high level period of the emission control timing control signal ECS. If Toff is 20% of a frame period, the timing controller 220 can transmit an emission control timing control signal ECS having high level period of which length is 20% of a frame period.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims. Various features of the above described and other embodiments can be mixed and matched in any manner, to produce further embodiments consistent with the invention.

What is claimed is:

1. An organic light emitting display device comprising:

a display panel including pixels; and a display panel driver configured to drive the display panel, wherein the display panel driver is arranged to receive a maximum brightness signal corresponding to one of a plurality of maximum brightnesses, wherein, when a first maximum brightness corresponding to the maximum brightness signal is lower than a first reference maximum brightness for a first frame, the display panel driver drives selected pixels among the pixels to emit light and non-selected pixels among the pixels not to emit light during a frame period of the first frame, the selected pixels of the first frame being non-selected pixels of a second frame, the non-selected pixels of the first frame being selected pixels of the second frame, the first maximum brightness being increased by an amount based on a number of the non-selected pixels, and an increased first maximum brightness being equally applied to the first frame and the second frame, wherein an average brightness of the first frame is the same as an average brightness of the second frame, and wherein, when a second maximum brightness is higher than the first reference maximum brightness and is lower than a second reference maximum brightness, the display panel driver drives all of the pixels to emit light during only part of the frame period, and wherein the second reference maximum brightness is higher than the first reference maximum brightness.

2. The organic light emitting display device of claim 1, wherein the display panel driver further comprises a maximum brightness look-up table configured to output data voltage levels based on input maximum brightness and grayscales, wherein, when a third maximum brightness is higher than the second reference maximum brightness, the display panel driver is programmed to input the third maximum brightness to the maximum brightness look-up table, and wherein, when the first maximum brightness or the second maximum brightness is lower than the second reference maximum brightness, the display panel driver is programmed to convert the first maximum brightness or the second maximum brightness into a value higher than the second reference maximum brightness so as to form a converted maximum brightness, and to input the converted maximum brightness to the maximum brightness look-up table.

3. The organic light emitting display device of claim 2, wherein the maximum brightness look-up table is included in the timing controller or the data driver.

4. The organic light emitting display device of claim 1, wherein the display panel driver comprises a timing controller configured to receive image signals, timing signals, and the maximum brightness signal, and to supply a scan timing control signal and a data timing control signal, wherein the timing controller comprises a whether-to-convert signal generator configured to generate a whether-to-convert signal, and an image signal converter configured to receive the whether-to-convert signal, wherein, when the first maximum brightness is lower than the first reference maximum brightness, the whether-to-convert signal generator is further configured to generate the whether-to-convert signal having a first logic value, the image signal converter is further configured to convert the image signals, and the timing controller is further configured to output the converted image signals, and wherein, when the second maximum brightness or a third maximum brightness is higher than the first reference maximum brightness, the whether-to-convert signal generator is further configured to generate the whether-to-convert signal having a second logic value different from the first logic value, and the timing controller is further configured to output the image signals.

5. The organic light emitting display device of claim 4, wherein the image signal converter is further configured to store pixel information corresponding to an image signal, and wherein, when the first maximum brightness is lower than the first reference maximum brightness, the image signal converter is further configured to generate the converted image signals of pixels having gray signals greater than a black gray-scale so that some of the converted image signals correspond to the black gray-scale.

6. The organic light emitting display device of claim 5, wherein, when the first maximum brightness is lower than the first reference maximum brightness, the timing controller is further configured to convert the first maximum brightness to a value higher than the second reference maximum brightness so as to form a converted maximum brightness, and wherein when the image signals are displayed based on the first maximum brightness average brightness of the corresponding pixels is substantially equal to an average rightness of the corresponding pixels when the converted image signals are displayed based n the converted maximum brightness.

7. The organic light emitting display device of claim 4, wherein the display panel further comprises:

data lines configured to transmit data voltages to the pixels;

scan lines configured to transmit scan signals to the pixels; and emission control lines configured to transmit emission control signals to the pixels, wherein the timing controller is configured to supply an emission control timing control signal, and wherein the display panel driver further comprises:

a data driver configured to generate the data voltages based on the image signals or the converted image signals, and to supply the data voltages to the data lines based on a timing at which the scan timing control signal is supplied;

a scan driver configured to supply the scan signals to the scan lines based on a timing at which the scan timing control signal is supplied; and an emission control driver configured to supply the emission control signals based on a timing at which the emission control timing control signal is supplied.

8. The organic light emitting display device of claim 7, wherein, when the second maximum brightness is higher than the first reference maximum brightness and is lower than the second reference maximum brightness, the mission control timing control signal comprises information describing a non-emission period, and wherein, when the third maximum brightness is higher than the second reference maximum brightness, the emission control timing control signal does not comprise the information describing the non-emission period.

9. The organic light emitting display device of claim 8, wherein, when the second maximum brightness is higher than the first reference maximum brightness and is lower than the second reference maximum brightness, the timing controller is configured to convert the second maximum brightness to a value higher than the second reference maximum brightness, and wherein when the image signals are displayed based on the second maximum rightness and an emission control timing control signal that does not include the information describing the non-emission period, an average brightness of the corresponding pixels is substantially equal to an average brightness of the corresponding pixels when the mage signals are displayed based on the converted maximum brightness and an emission control timing control signal including the information describing the non-emission period.

10. The organic light emitting display device of claim 1, wherein, when the first maximum brightness is lower than the first reference maximum rightness, the pixels do not emit light during a portion of the frame period.

11. A method of driving an organic light emitting display device including a display panel having pixels and a display panel driver configured to drive the display panel, the method comprising:

receiving image signals and timing signals;

receiving a maximum brightness signal corresponding to one of a plurality of maximum brightnesses;

converting the image signals;

generating an emission control timing control signal including information on a non-emission period;

calling a look-up table; and directing the pixels to emit light, wherein the converting is conditionally performed when the first maximum brightness is lower than a first reference maximum brightness, wherein the generating is conditionally performed when the second maximum brightness is higher than the first reference maximum brightness and is lower than a second reference maximum brightness, wherein the second reference maximum brightness is higher than the first reference maximum brightness, and wherein, when the first maximum brightness is lower than a first reference maximum brightness, the display panel driver drives selected pixels among the pixels to emit light and non-selected pixels among the pixels not to emit light during a frame period of a first frame, the selected pixels of the first frame being non-selected pixels of a second frame, the non-selected pixels of the first frame being selected pixels of the second frame, the first maximum brightness being increased by an amount based on a number of the non-selected pixels, and an increased first maximum brightness being equally applied to the first frame and the second frame, wherein an average brightness of the first frame is the same as an average brightness of the second frame.

12. The method of claim 11, wherein the generating is performed after the converting.

13. The method of claim 11, wherein the converting further comprises generating an emission control timing control signal that does not include the information on the non-emission period is generated.

14. The method of claim 11, further comprising converting the one of the plurality of maximum brightnesses, wherein the converting the one of the plurality of maximum brightnesses is performed after the converting the image signals or the generating an emission control timing control signal, and is performed before the calling the look-up table.

15. The method of claim 14, wherein the converting the image signals comprises:

generating pixel information; and converting image signals corresponding to some of the pixel information having gray signals greater than a black gray-scale to correspond to the black grayscale.

16. The method of claim 15, wherein the converting the one of the plurality of maximum brightnesses further comprises generating a converted maximum brightness, and wherein a level of the converted maximum brightness is set so that an average rightness of pixels when the image signals are displayed based on the one of the plurality of maximum brightnesses is substantially equal to an average brightness of pixels when converted image signals are displayed based on the converted maximum brightness.

17. The method of claim 14, wherein the generating the mission control timing control signal further comprises:

determining a length of the non-emission period; and generating the emission control timing control signal based on the determined length of the non-emission period.

18. The method of claim 17, wherein the converting the one of the plurality of maximum brightnesses further comprises generating a converted maximum brightness, and wherein a level of the converted maximum brightness is set so that an average brightness of pixels when the image signals are displayed based on the one of the plurality of maximum brightnesses and the emission control timing control signal that does not include the information on the non-emission period is substantially equal to an average brightness of pixels when the image signals are displayed based on the converted maximum brightness and the emission control timing control signal including the information on the non-emission period.

19. The method of claim 11, further comprising, when the third maximum brightness is higher than the second reference maximum brightness, generating emission control timing control signal that does not include information on a non-emission period.

* * * * *